US005653028A

United States Patent [19]

Hashimoto

[11] Patent Number: 5,653,028

[45] Date of Patent: Aug. 5, 1997

[54] SAW BLADE MACHINE AND TRIMMER

[75] Inventor: Masaya Hashimoto, Mobara, Japan

[73] Assignee: Maruyama Mfg. Co., Inc., Tokyo, Japan

[21] Appl. No.: 574,189

[22] Filed: Dec. 18, 1995

[51] Int. Cl.[6] ..... B27B 17/12

[52] U.S. Cl. ..... 30/123.4; 30/384

[58] Field of Search ..... 30/122, 123, 123.3, 30/123.4, 383, 384, 381

[56] References Cited

U.S. PATENT DOCUMENTS

| | | | |
|---|---|---|---|
| 3,938,622 | 2/1976 | Densow | 30/123.4 |
| 4,353,163 | 10/1982 | Overbury et al. | 30/123.4 |
| 4,813,139 | 3/1989 | Nagashima | 30/123.4 |
| 4,819,332 | 4/1989 | Sugihara et al. | 30/123.4 |
| 4,884,340 | 12/1989 | Newman | 30/123.4 |
| 4,893,407 | 1/1990 | Lane | 30/123.4 |
| 5,088,197 | 2/1992 | Anderson | 30/122 |

*Primary Examiner*—Hwei-Siu Payer

*Attorney, Agent, or Firm*—Cushman, Darby & Cushman

[57] ABSTRACT

A trimmer which can reduce the size of a section including a lubricating oil pump for automatically supplying a lubricating oil to a saw chain during the drive of the saw chain and drive shaft members for driving the saw chain, and secure good mountability of the section. In the trimmer, a gear unit is mounted to the forward end portion of an operating rod, and a gearcase of the gear unit, a mount base and a seal case are mutually connected toward an output shaft. A regenerative pump includes a stirring chamber defined between the mount base and the seal case, and a tabular grooved rotor which is fitted to a drive shaft to be coaxially connected to the output shaft and which is rotated in the stirring chamber in accordance with the rotation of the output shaft. Lubricating oil discharged from the regenerative pump is supplied to a saw chain through a supply port of the mount base, through-holes of the chain bar, through-slots and a guide groove.

3 Claims, 9 Drawing Sheets

SAW BLADE MACHINE AND TRIMMER

BACKGROUND OF THE INVENTION

1. Field of the Invention

The present invention relates to a saw blade machine provided with a saw blade such as a saw chain and a reciprocating blade, and to a trimmer provided with a saw chain. More particularly, the present invention relates to a saw blade machine and a trimmer in which a section including a lubricating oil pump for automatically supplying a lubricating oil to a saw blade during operation is reduced in size.

2. Description of the Related Art

In a saw blade machine such as a chain saw, a trimmer and an edger for cutting trees and branches and for trimming an edge of a lawn, it is necessary to suitably supply a lubricating oil to the saw blade so as to prevent the saw blade burn-up during operation.

A device for supplying a lubricating oil to the saw chain in the conventional chain saw comprises a worm fixedly mounted to a predetermined section of an engine crankshaft rotatively driving the saw chain, a worm wheel meshed with the worm and mounted onto a periphery of a plunger, and a single twin-helical guide groove formed on the periphery of the base portion of the plunger and having a positioning pin inserted therein. With the rotation of the crankshaft, the plunger is reciprocally displaced in the axial direction while rotating in the circumferential direction to increase or decrease a capacity of a pump room so that the lubricating oil is discharged from the pump room to supply it to the saw chain.

According to a chain saw disclosed in U.S. Pat. No. 4,353,163, a rotation power of an engine for driving the saw chain is transmitted to an input shaft of a vane pump through spur gears meshed with each other so that the lubricating oil is discharged from the vane pump to supply it to the saw chain.

In U.S. Pat. No. 4,884,340, there is disclosed a thumb-operated pump, and an operator suitably operates the pump to supply the lubricating oil from the pump to the saw chain.

According to a manual type lubricating oil pump, the operator is required to manually operate the lubricating oil pump while performing a cutting operation. This may result in an increase of the labor, and tends to burn up the saw chain when the operator forgets the manual operation for supply of the lubricating oil. Further, the manual type lubricating oil pump is likely to result in a deterioration in stability of operation and an unforeseen accident may be also apprehended.

According to the chain saw employing an automatic drive lubricating oil pump such as a plunger pump and a vane pump, an input shaft of the lubricating oil pump is provided separately from a drive shaft members for driving the saw blade and a section including the drive shaft members and the lubricating oil pump is increased in size. In addition, since the plunger pump and the vane pump include a large number of parts and high accuracy is required for manufacturing these pumps, efficiency in manufacturing and mounting these pumps is reduced.

SUMMARY OF THE INVENTION

It is an object of the invention as claimed in claim 1 to reduce the size of a section including drive shaft members for driving a saw blade and a lubricating oil pump in a saw blade machine comprising the lubricating oil pump capable of automatically supplying the lubricating oil to the saw blade, and to manufacture and mount efficiently the lubricating oil pump itself.

It is an object of the invention as claimed in claim 2 to advantageously apply the saw blade machine of claim 1 for a saw blade machine of an operating rod type.

It is an object of the invention as claimed in claim 3 to provide a favorable embodiment of the saw blade machine of claim 2.

It is an object of the invention as claimed in claim 4 to provide a trimmer in which a section including a lubricating oil pump capable of automatically supplying a lubricating oil to a saw chain and drive shaft members for driving the saw chain is reduced in size, a mounting properties of the section is improved and the lubricating oil pump itself is efficiently manufactured and mounted.

It is an object of the invention as claimed in claim 5 to provide a trimmer in which further reduction in size and efficient manufacturing of the section including the lubricating oil tank in addition to the lubricating oil pump and drive shaft members can be planned.

It is an object of the invention as claimed in claim 6 to provide a trimmer capable of adjusting a supply of the lubricating oil to the saw chain regardless of the rotating speed of the drive shaft members for driving the saw chain.

The present invention will now be described employing reference numerals of the drawings corresponding to a preferred embodiment of the invention.

A saw blade machine 10 of claim 1 comprises the following components (a) to (c):

(a) drive shaft members 48 and 62 for driving a saw blade 32;

(b) a regenerative pump 64 including a tabular rotor 70 integrally fitted to the drive shaft members 48 and 62 in a rotating direction and discharging a lubricating oil; and (c) oil passages 114, 138 and 150 conducting the lubricating oil from the regenerative pump 64 to the saw blade 32.

A saw blade machine 10 of claim 2 further includes the following components (d) to (f) in the saw blade machine 10 as claimed in claim 1:

(d) a power section 18 mounted on the base side of an operating rod 34;

(e) a transmission shaft 36 extending in the operating rod 34 and transmitting a rotation power from the power section 18; and (f) a gear unit 28 mounted on the forward and portion of the operating rod 34 and transmitting the rotation power of the transmission shaft 36 to the drive shaft members 48 and 62 being in right angles to the transmission shaft 36.

According to a saw blade machine 10 of claim 3, the saw blade 32 is a saw chain 32 or a reciprocating blade in the saw blade machine 10 as claimed 1 or 2.

A trimmer 10 of claim 4 includes the following components (a) to (i):

(a) a power section 18 being mounted on the base side of an operating rod 34 and generating a rotation power;

(b) a transmission shaft 36 extending in the operating rod 34 and transmitting a rotation power from the power section 18;

(c) a gear unit 28 mounted on the forward end side of the operating rod 34, and transmitting the rotation power of the transmission shaft 36 to an output shaft 48 being in right angles to the transmission shaft 36;

(d) a joint case 54 to be joined to a gearcase 40 of the gear unit 28 from the forward end side of the output shaft 48;

(e) a seal case 58 to be joined to the joint case 54 from the forward end side of the output shaft 48;

(f) a connecting shaft 62 being coaxially connected to the output shaft 48 and projecting toward the outside of the seal case 58;

(g) a regeneratiave pump 64 including a stirring chamber 66 defined between the joint case 54 and the seal case 58, and a tabular rotor 70 disposed in the stirring chamber 66 and fitted to the output shaft 40 or the connecting shaft 62 to be rotated in accordance with the rotation of the output shaft 48;

(h) a saw chain 32 moving along a guide groove 132 formed in a periphery of a chain bar 30 fixed to the joint case 54 by the rotation power from the connecting shaft 62; and (i) oil passages 114, 138 and 150 including a through-slot 138 formed in the chain bar 30 to be communicated with the guide groove 132 and conducting the lubricating oil from the regenerative pump 64 to the guide groove 132.

According to a trimmer 10 of claim 5, the joint case 54 is integrally provided with a lubricating oil tank 78 storing the lubricating oil drawn by the regenerative pump 64.

A trimmer 10 of FIG. 8 further includes a screw member 156 being displaced in the axial direction in accordance with increase or decrease of screwing amount so as to increase or decrease flow passage cross-sectional areas of the oil passages 114, 138 and 150.

According to the saw blade machine 10 as claimed in claim 1, the tabular rotor 70 of the regenerative pump 64 is fitted to the drive shaft members 48 and 62 to be integrally rotated therewith so as to introduce and discharge the lubricating oil. The lubricating oil discharged from the regenerative pump 64 is conducted and supplied to the saw blade 32 through the oil passages 114, 138 and 150.

According to the saw blade machine 10 as claimed in claim 2, a rotation power generated in the power section 18 is transmitted to the gear unit 28 through the transmission shaft 36 in the operating rod 34, and further, transmitted to the drive shaft members 48 and 62 being in right angles to the transmission shaft 36 through the gear unit 28.

According to the saw blade machine 10 as claimed in claim 3, the saw chain 32 or a reciprocating blade is driven by the drive shaft members 48 and 62, and moves around or reciprocates so as to cut materials to be cut.

According to the trimmer 10 as claimed in claim 4, the gear unit 28, the joint case 54 and the seal case 58 are disposed in order toward the output shaft 48 of the gear unit 28 to be mutually connected. The chain bar 30 is connected to the joint case 54 to guide the saw chain 32 by means of the guide groove 132 formed in the periphery thereof. The rotation power generated in the power section 18 is transmitted to the gear unit 28 of the forward end side of the operating rod 34 through the transmission shaft 36 in the operating rod 34. The rotation power is changed its transmission direction at the right angle in the gear unit 28 to be transmitted to the output shaft 48, and further transmitted to the saw chain 32 through the connecting shaft 62. The stirring chamber 66 in the regenerative pump 64 is defined between the gearcase 40 and the joint case 54. The tabular rotor 70 of the regenerative pump 64 rotates in accordance of the rotation of the output shaft 48 in a state of fitting to the output shaft 48 or the connecting shaft 62 and accelerates the lubricating oil in the stirring chamber 66, thereby introducing and discharging the lubricating oil to and from the stirring chamber 66. The lubricating oil discharged from the regenerative pump 64 is conducted to the guide groove 132 through the through-slot 138 of the chain bar 30 and supplied to the saw chain 32 from the guide groove 132.

According to the trimmer 10 as claimed in claim 5, the lubricating oil tank 78 is formed integrally with the joint case 54, and the regenerative pump 64 introduces the lubricating oil from the lubricating oil tank 78.

According to the trimmer 10 as claimed in claim 6, the screw member 156 is displaced in the axial direction in accordance with increase or decrease of the screwing amount thereof. The flow passage cross-sectional areas of the oil passages 114, 138 and 150 are increased or decreased in accordance with the axial displacement of the screw member 156, thereby changing the flow rate of the lubricating oil supplied to the saw chain 32 through the oil passages 114, 138 and 150.

DESCRIPTION OF THE PREFERRED EMBODIMENT

A preferred embodiment of the present invention will be described with reference to the accompanying drawings.

Figure 11:
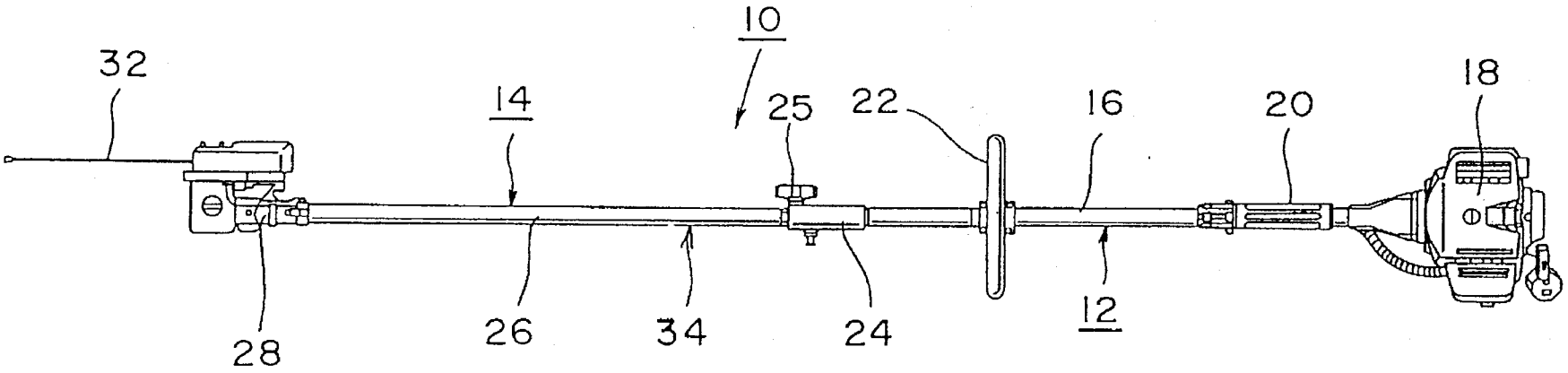
FIG. 11 is a plan view showing the entire trimmer according to the present invention.
Figure 12:
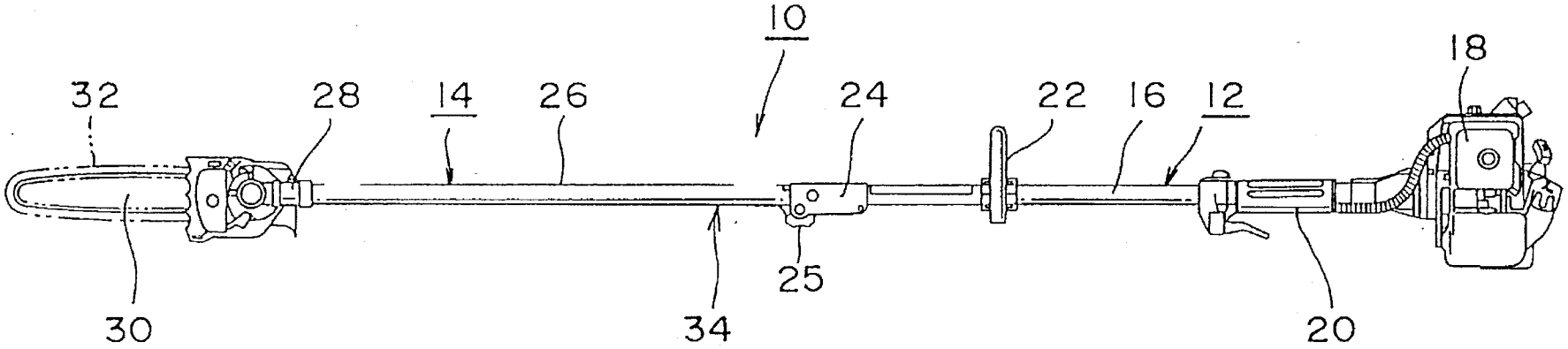
FIG. 12 is a side view showing the entire trimmer of FIG. 11.

FIGS. 11 and 12 are views in top plan and side elevation, respectively, showing a trimmer 10 of the present invention. The trimmer 10 consists of a power unit 12 of a base side thereof and an attachment 14 of a forward end side thereof which are connected to each other in such a way that they can be separated from each other. In the power unit 12, an engine section 18 includes an engine generating a rotation power and is mounted on a base side of an outer tube 16. A grip 20 is provided on the outer tube 16 adjacent its engine section 18, and is gripped by one hand of an operator. A handle 22 is provided on the outer tube 16 adjacent its forward end, and is gripped by the other hand of the operator. A coupler 24 is mounted on the forward end of the outer tube 16, and a base portion of an outer tube 26 of the attachment 14 is fitted therein from the forward end side in such a way that it can be inserted into and extracted from the coupler 24. The base portion of the outer tube 26 of the attachment 14 is clamped and secured by rotating a knob 25. In the attachment 14, a gear unit 28 is mounted on the forward end of the outer tube 26, and a chain bar 30 is disposed at the side part of the gear unit 28 so as to engage a saw chain 32 therearound. The outer tubes 16 and 26 constitute an operating rod 34.

A transmission shaft 36 (see FIG. 1) consists of a base side part (not shown) of the power unit 12 side and a forward end side part 39 (see FIG. 1) of the attachment 14 side, and the base side part of the power unit 12 side and the forward end side part of the attachment 14 side are connected to and separated from each other in accordance with the connection and the separation of the power unit 12 and the attachment 14 due to the coupler 24. When connected, they are integral with each other in the rotating direction due to a mutual fitting of non-circular contour portions thereof. The transmission shaft 36 extends into the operating rod 34 so as to transmit the rotation power from the engine section 18 to the gear unit 28. By replacing the attachment 14 with another attachment for brush cutter and edger use, the trimmer 10 can be used as another working machine of an operating rod type such as a brush cutter and an edger while using a common power unit 12.

Figure 1:
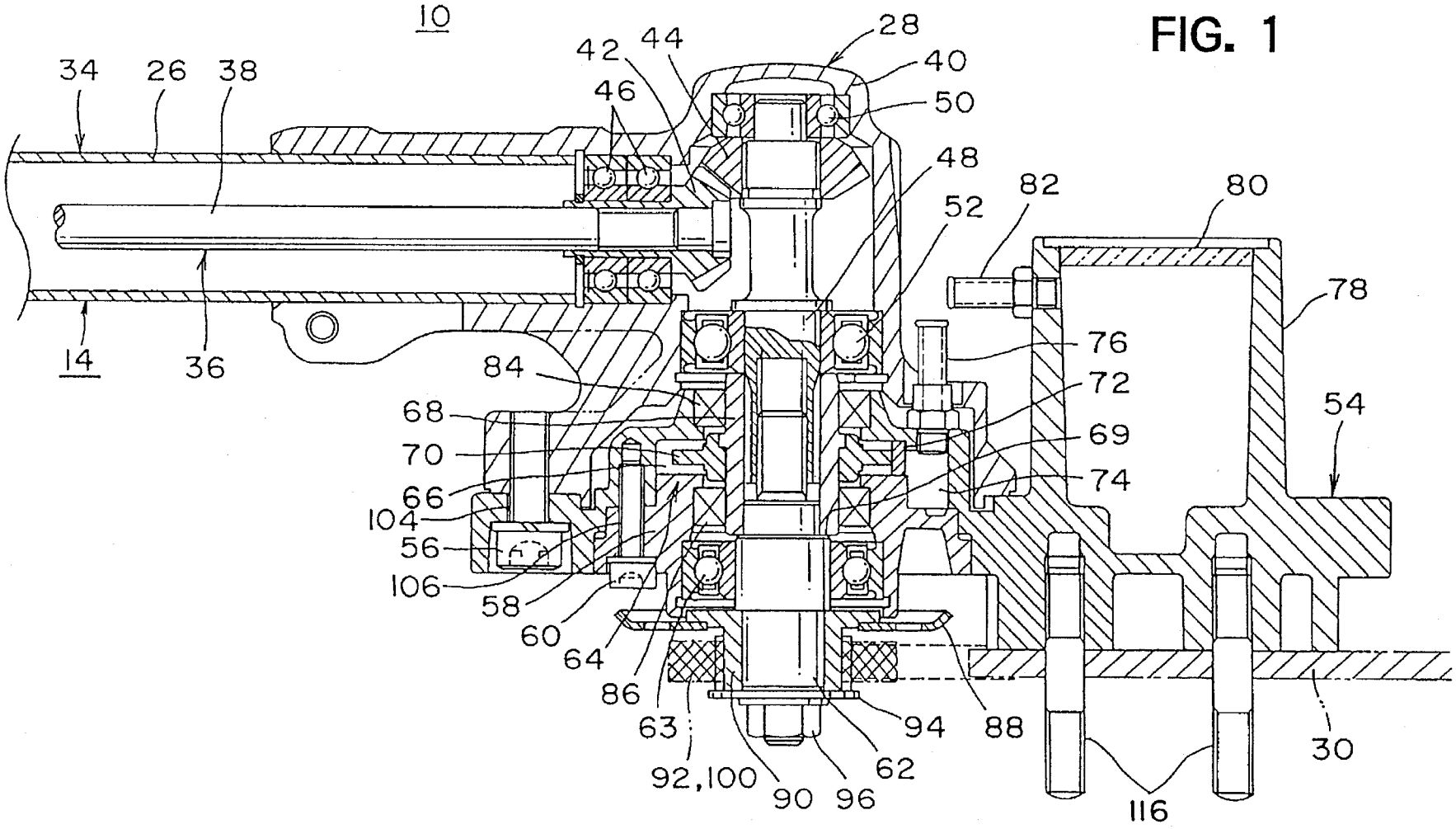
FIG. 1 is a sectional view showing a structure of the forward end portion of a trimmer according to the present invention.

FIG. 1 is a sectional view which illustrates a structure of the forward end portion of the trimmer 10. Referring to FIG. 1, a gearcase 40 of the gear unit 28 is provided with bevel gears 42 and 44 which are meshed with each other by making the center lines thereof cross at right angles. The bevel gear 42 is journaled on the gearcase 40 by means of a ball bearing 46 so as to be integrally coupled to the forward end portion of the forward end side part 38 in the rotating direction. An axial direction of an output shaft 48 is at right angles to the forward end side part 38. The output shaft 48 is journaled on the gearcase 40 at both end portions thereof through ball bearings 50 and 52, and is integrally fitted to the bevel gear 44 in the rotating direction at base portion thereof. A mount base 54 is abutted against the gearcase 40 from the forward end side of the output shaft 48, and total three clamping bolts 56 are screwed into screw holes of the gearcase 40 after being inserted into insertion holes 104 of the mount base 54 so as to clamp the mount base 54 to the gearcase 40. A seal case 58 is abutted against the mount base 54 from the opposite side of the gearcase 40, and total three clamping bolts 60 are screwed into screw holes 106 of the mount base 54 after being inserted into insertion holes of the seal case 58 so as to clamp the seal case 58 to the mount base 54. A drive shaft 62 is threadedly engaged with a tip portion of the output shaft 48 by aligning the center line thereof with that of the output shaft 48 to be integrally rotated with the output shaft 48. A ball bearing 63 is disposed at a portion of the drive shaft 62 protruded from the seal case 58 so as to journal the drive shaft 62 on the seal case 58.

A regenerative pump 64 includes a stirring chamber 66 defined between the mount base 54 and the seal case 58; a boss 68 spline-fitted to the outer peripheral tip portion of the output shaft 48, and abutted against an inner ring of the ball bearing 52 and a step portion 69 of the drive shaft 62 at both ends thereof; and a grooved rotor 70 disposed in the stirring chamber 66 and mounted on the boss 68 in such a way that it can be separated from or fixed to the boss 68. When the grooved rotor 70 can be separated from the boss 68, a discharge amount of the regenerative pump 64 may be changed by exchanging the grooved rotor 70. When the grooved rotor 70 is integrally mounted on the boss 68, efficiency in assembling the boss 68 and the grooved rotor 70 to the output shaft 48 and the drive shaft 62 may be increased. A partition member 72 is disposed at a predetermined position in the stirring chamber 66 so as to partition the inside of the stirring chamber 66 in the circumferential direction. The stirring chamber 66 is communicated at both ends of the partition member 72 with an inlet 108 and outlet 74 (see FIG. 4). The lubricating oil is accelerated in the stirring chamber 66 in accordance with the rotation of the grooved rotor 70 of the regenerative pump 64, and introduced from the inlet 108 to collide with the partition member 72 and then, discharged to the outlet 74. A nipple 76 is threadedlly engaged with the mount base 54 to be communicated with the inside of the outlet 74, and tip portion thereof is exposed from the gearcase 40. The mount base 54 includes a portion protruding from the gear unit 29 along the chain bar 30, and an oil tank 78 is integrally formed on the gear unit 28 side of the protruded portion. An opening of the oil tank 78 is blocked by means of a transparent plate 80 through which the inside of the oil tank 78 can be seen from the outside. A nipple 82 is screwed to the oil tank 78 so as to be communicated with the inside of the oil tank 78. Oil seals 84 and 86 are fitted into the outer peripheral portion of the boss 68 in such a manner that they sandwich the stirring chamber 66 from both sides of the axial direction thereof so as to seal the stirring chamber 66.

Figure 2:
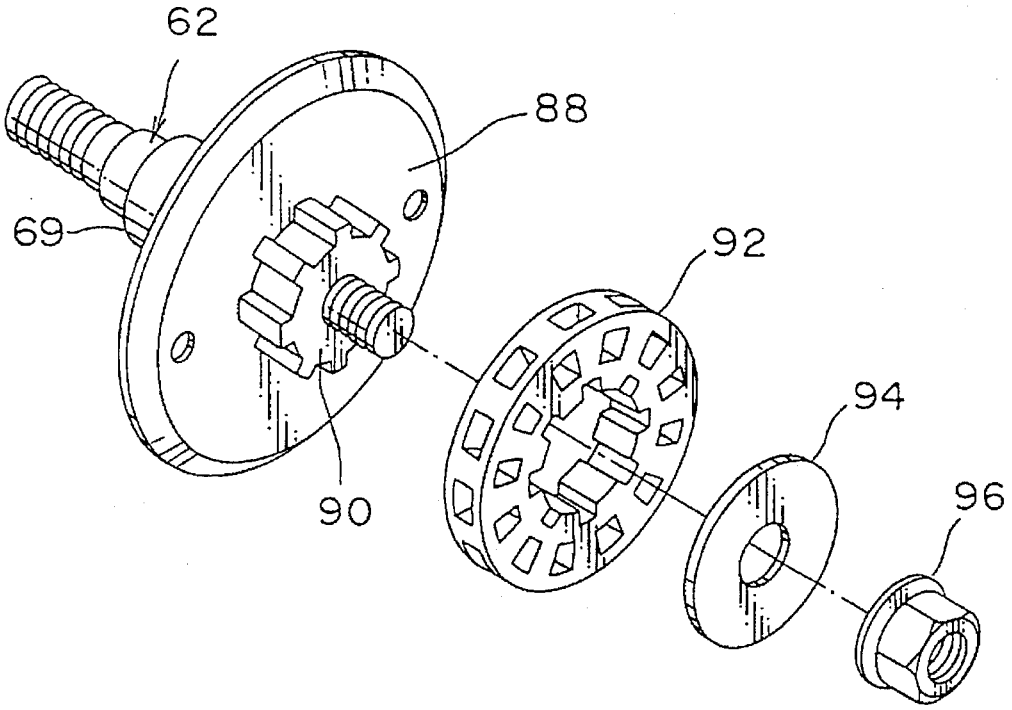
FIG. 2 is an exploded view showing a mounting of a spline boss and a rim, etc. onto a drive shaft.

FIG. 2 is an exploded view which illustrates mounting of a spline boss 90 and a rim 92, etc. onto the drive shaft 62. Referring to FIGS. 1 and 2, the spline boss 90 is provided with a radially stretching flange 88, and fitted to the tip portion of the drive shaft 62 in such a manner that the flange 88 covers the seal case 58 of the ball bearing 63 side. A nut 96 is screwed to the tip portion of the drive shaft 62 and clamps the spline boss 90 through a washer 94 so that the spline boss 90 is integrally connected to the drive shaft 62 in the rotating direction. The rim 92 is spline-fitted to the periphery of the spline boss 90 between the flange 88 and the washer 94, and integrally rotated with the drive shaft 62. Once the saw chain 32 is engaged with the rim 92, it is not disengaged therefrom in the axial direction of the drive shaft 62. Thus, the role of the washer 94 is only to prevent the rim 92 from slipping out the spline boss 90.

Figure 3:
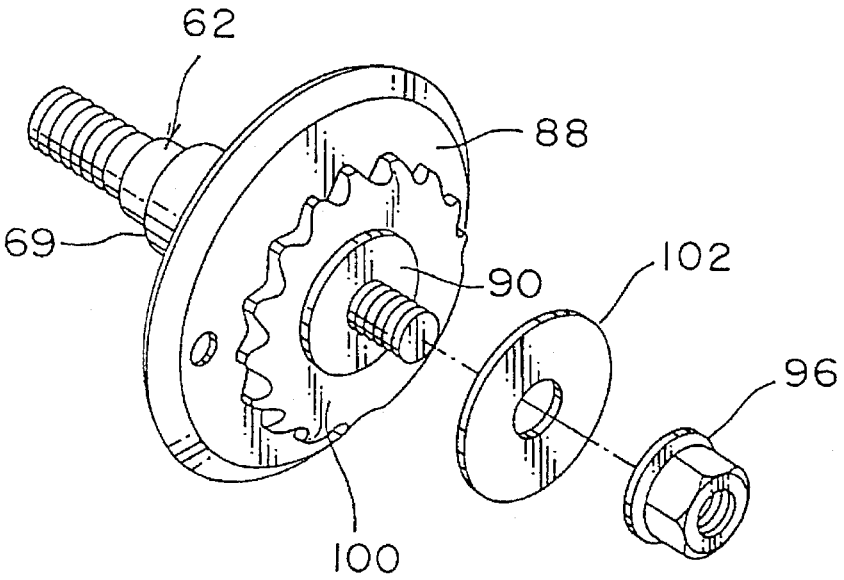
FIG. 3 is an exploded view showing a mounting of a sprocket in place of the rim onto the drive shaft.

FIG. 3 is an exploded view which illustrates mounting of a sprocket 100 in place of the rim 92 onto the drive shaft 62. The sprocket 100 is fastened to the spline boss 90 so as to be prevented from slipping out the spline boss 90. However, the saw chain 32 may be disengaged from the sprocket 100 in the axial direction of the drive shaft 62. Thus, a washer 102 is made to have efficiently larger diameter than that of the washer 94 shown in FIG. 2, and abuts against the saw chain 32 so as to prevent the saw chain 32 from disengaging from the sprocket 100.

Figure 4:
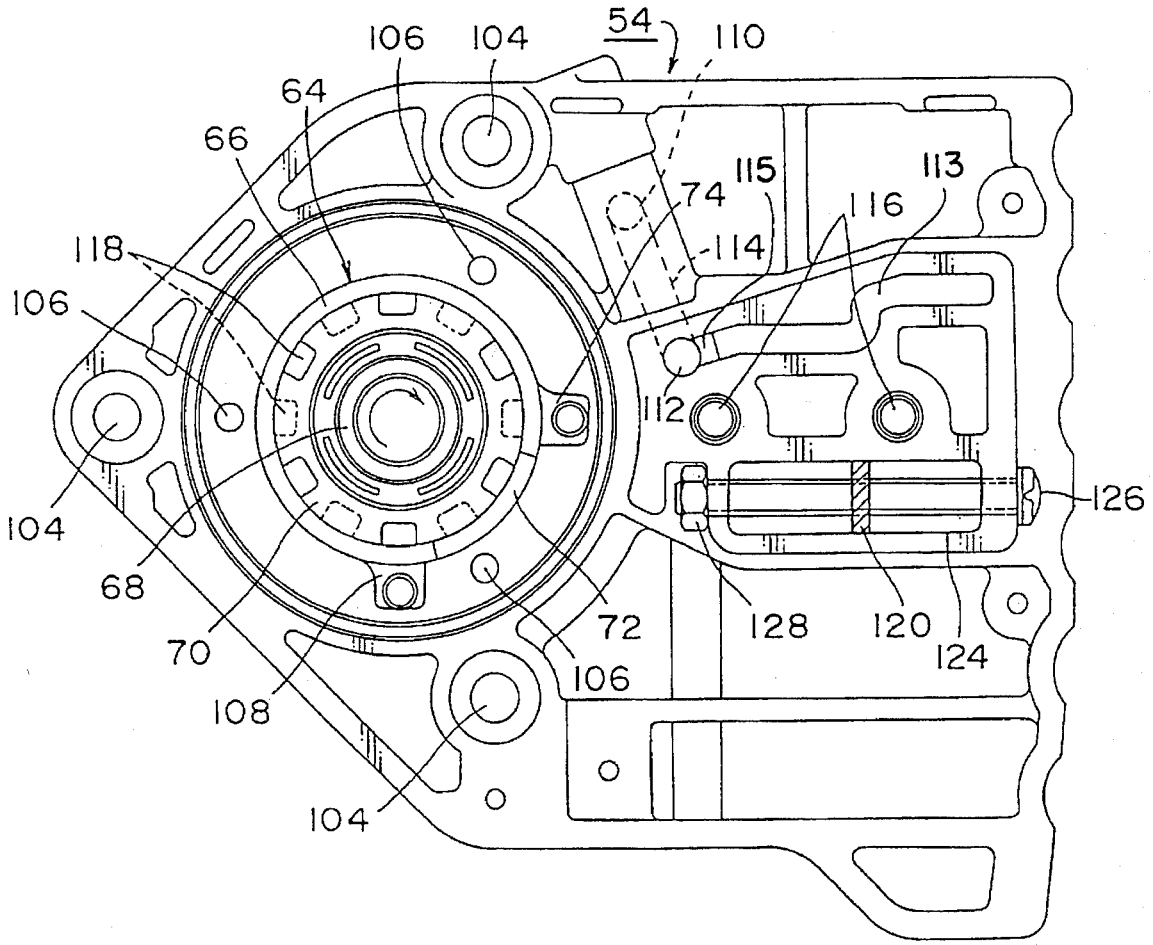
FIG. 4 is a view showing a mount base viewed from a seal case side.

FIG. 4 is a view which illustrates the mount base 54 viewed from the seal case 58 side. Three insertion holes 104 are arranged at equal intervals on a concentric circle about the center line of the regenerative pump 64, and the screw holes 106 are arranged at equal angles on another concentric circle about the center line of the regenerative pump 64. The inlet 108 and the outlet 74 are separated from each other at a predetermined angle in the rotating direction of the grooved rotor 70, and the partition member 72 partitions the inlet 108 and the outlet 74 while maintaining a non-contact state with the grooved rotor 70 at the inner periphery side thereof so as to prevent the connection of the inlet 108 and the outlet 74. The partition member 72 may be integral with the mount base 54 if it plays a role as described above. A nipple 110 is mounted on the surface of the gearcase 40 side of the mount base 54. A supply port 112 is opened in a section of the mount base 54 which is in approximately closely contact with the chain bar 30, and is communicated with the nipple 110 through a passage 114 in the mount base 54. The supply port 112 is also communicated with a groove 113 capable of forming an oil passage at the surface thereof contacting the chain bar 30 through a shallow groove 115. The shallow groove 115 is shallower than the groove 113, and located near the supply port 112. The flow of the lubricating oil from the supply port 112 is accelerated in the shallow groove 115, thereby preventing chips of wood and the like entered the groove 113 from flowing back to the supply port 112.

Figure 5:
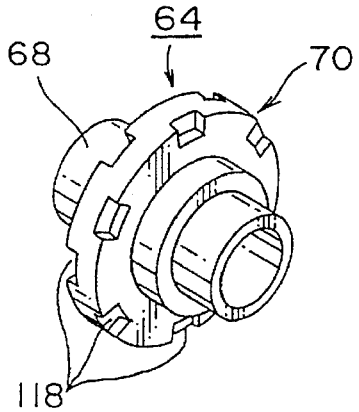
FIG. 5 is a perspective view of a regenerative pump showing a state where a boss and a grooved rotor are mounted to the pump.

FIG. 5 is a perspective view of the regenerative pump 64 showing a state where the boss 68 and the grooved rotor 70 are mounted onto the regenerative pump 64. Referring to FIGS. 4 and 5, a plurality of stirring grooves 118 are formed in both peripheral surfaces of the grooved rotor 70 at equal angles in such a manner that they do not overlap each other in the circumferential direction. If the lubricating oil has a sufficient viscosity, the stirring grooves 18 may be omitted. If the boss 68 and the grooved rotor can be integrally rotated, it doesn't matter whether or not they are separated.

Figure 6:
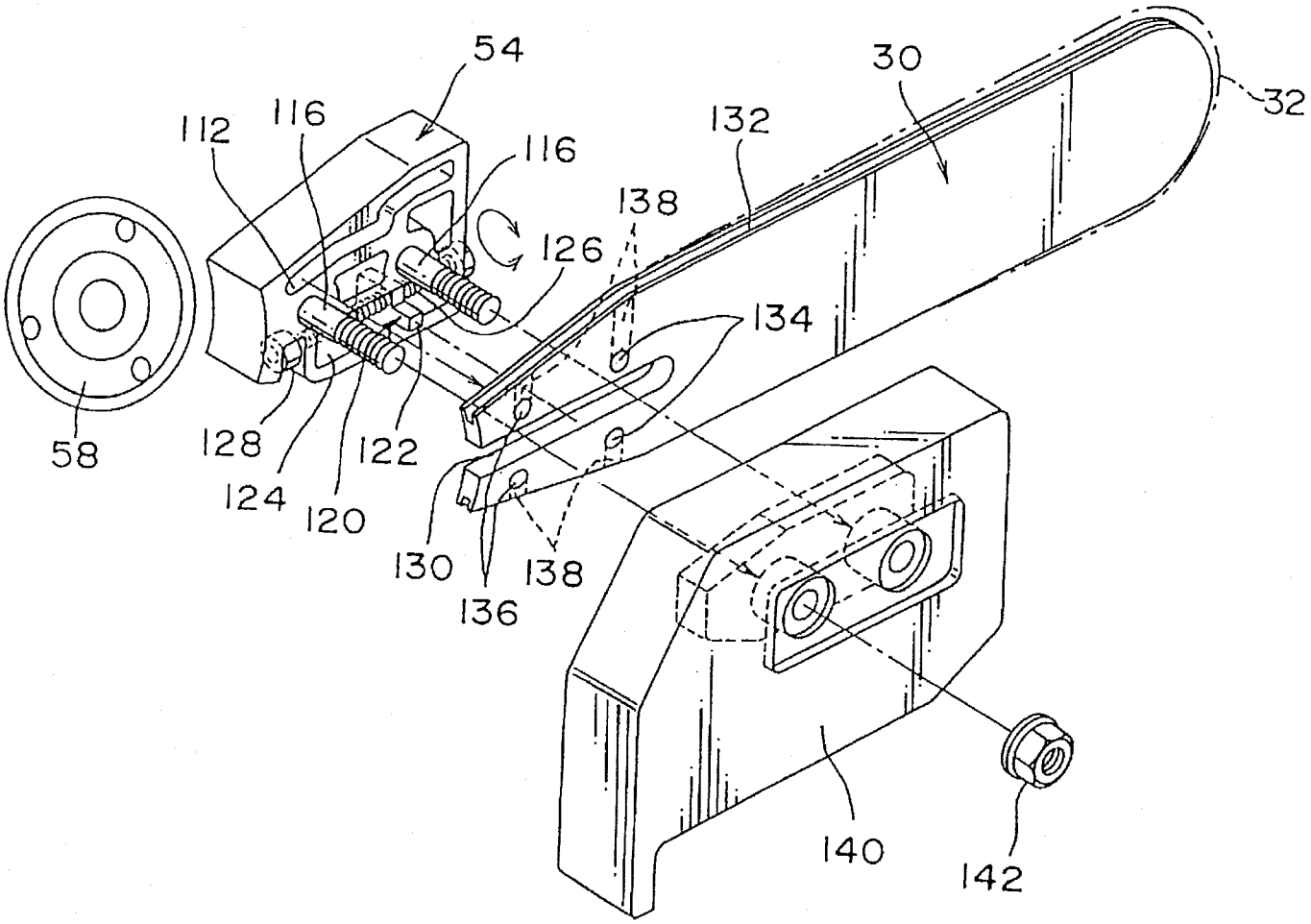
FIG. 6 is an exploded view showing a mounting of a chain bar, etc. onto the mount base.

FIG. 6 is an exploded view which illustrates mounting of the chain bar 30, etc. onto the mount base 54. Stud bolts 116 are fixed to the mount base 54 with a space therebetween in the longitudinal direction, that is, the axial direction of the operating rod 34, and projected toward the chain bar 30 (also see FIG. 4). A long slot 124 formed under the stud bolts 116 extends in the arrangement direction of the stud bolts 116 and is rectangular in cross section. A tensioner 120 has a shape identical to that of the cross section of the long slot 124, and is movably arranged in the long slot 124 in the extending direction thereof. The rotation of the tensioner 120 in the circumferential direction is restrained by the abutment thereof against the side wall of the long slot 124, and a projection 122 is projected from the long slot 124 toward the chain bar 30. A bolt 126 penetrates the long slot 124 to be screwed to a nut 128 at the outside of the long slot 124 while exposing a head potion (see FIG. 4) thereof from the mount base 54 and allowing a shank thereof to be threadedlly engaged with the tensioner 120. Since the rotation of the tensioner 120 is restrained by the long slot 124, the rotation of the bolt 126 allows the tensioner 120 to be displaced in the long slot 124 in the extending direction thereof. A guide slot 130 extends at a predetermined length from a base portion of the chain bar 30 in the extending direction of the chain bar 30 so that the stud bolts 116 can be inserted therein. A guide groove 132 is formed along the periphery of the chain bar 30, and the saw chain 32 is partially inserted therein to be guided along the periphery of the chain bar 30. Pairs of through-holes 134 and 136 are formed in the chain bar 30, on the base end and forward sides, respectively, with the through-holes of each pair being arranged one on the upper side and the other on the lower side of the guide slot 130.

Figure 7:
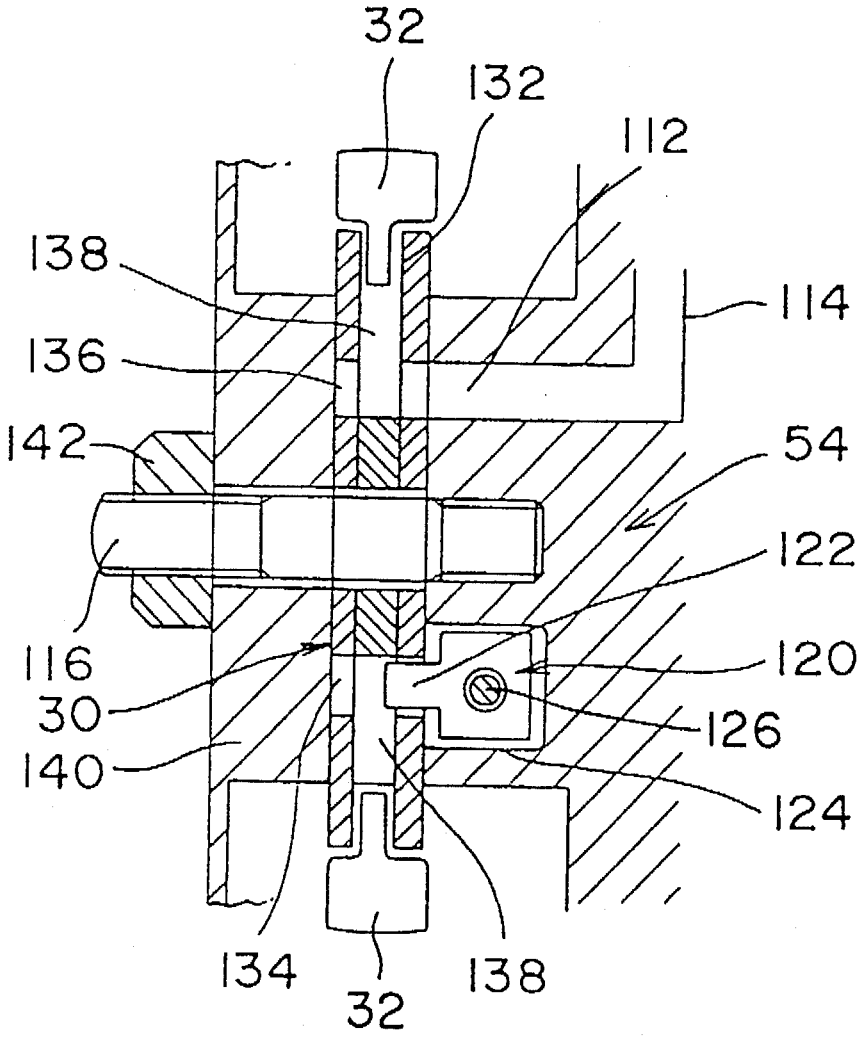
FIG. 7 is a sectional view of a section of a stud bolt in a state of mounting the chain bar and a side cover onto the mount base.

FIG. 7 is a sectional view of the section of the stud bolt 116 in a state of mounting the chain bar 30 and a side cover 140 onto the mount base 54. In FIG. 7, however, the upper half portion is a vertical section passing the through-hole 136 on the base side, and the lower half portion is a vertical section passing a through-slot 138. Referring to FIGS. 6 and 7, the saw chain 32 has a vertical symmetric shape. Even if the saw chain 32 is turned upside down, the supply port 112 is mated with the upper through-hole 136 and the projection 122 of the tensioner 120 is fitted into the lower through-hole 134. The side cover 140 covers the base portion of the chain bar 30 from the opposite side of the mount base 54, and a clamping nut 142 is screwed from the outer surface side of the side cover 140 to a portion of the stud bolt 116 projected from the side cover 140 so as to clamp the chain bar 30 and the side cover 140 to the mount base 54. The through-slot 138 is formed in the chain bar 30, and extends vertically from the through-holes 134 and 136 to the opposite side of the guide slot 130 for communication of the through-holes 134 and 136 with the guide groove 132.

In order to give a suitable tension to the saw chain 32, the tensioner 120 is brought sufficiently near the seal case 58 side, the chain bar 30 having the saw chain 32 engaged with the guide groove 132 is mounted onto the mount base 54, the saw chain 32 is engaged with the rim 92 or the sprocket 100 and thereafter, the bolt 126 is rotated so as to locate the tensioner 120 away from the seal case 58 side. By this, the tensioner 120 moves in the log slot 124 in the arrangement direction of the stud bolt 116 and the projection 122 moves the chain bar 30 in the arrangement direction of the stud bolts 116 through the through-holes 134. As a result, the projection 122 takes the chain bar 30 to the forward end thereof with respect to the mount base 54 and the side cover 140 through the through-hole 134, thereby giving tension to the saw chain 32.

Figure 8:
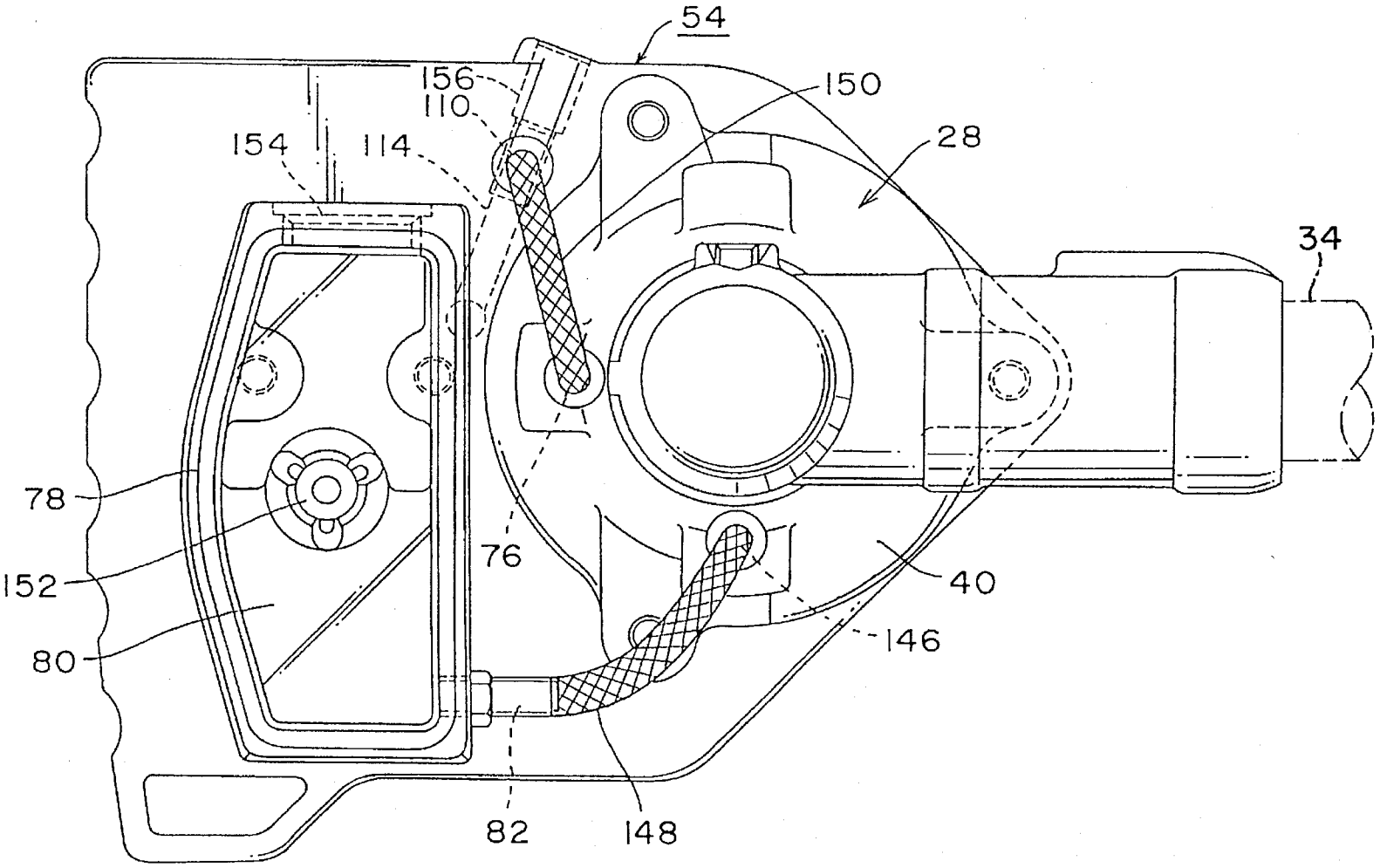
FIG. 8 is a view showing a gear unit and the mount base viewed from the opposite side of the chain bar.

FIG. 8 illustrates the gear unit 28 and the mount base 54 viewed from the opposite side of the chain bar 30. A nipple 146 is communicated with the inlet 108 (see FIG. 4) and projected from the gearcase 40. An inlet hose 148 is mounted to the nipples 82 and 146, respectively, at both end portions thereof, and an outlet hose 156 is mounted to the nipples 76 and 110, respectively, at both end portions thereof. A screw 152 penetrates the transparent plate 80 from the outer surface thereof to be screwed to the mount base 54 so as to fix the transparent plate 80 to an opening of the oil tank 78. An intake 154 is opened and closed by means of a lid (not shown) and used for introducing the lubricating oil into the oil tank 78. A communication passage having a small cross-sectional area is formed between the transparent plate 80 and the edge of the opening of the oil tank 78 so as to allow air to pass therethrough.

Figure 9:
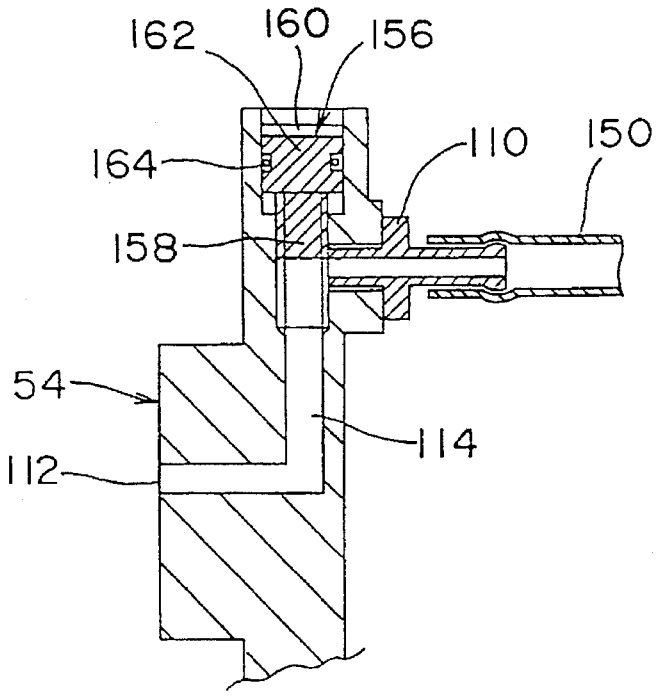
FIG. 9 is a sectional view showing a structure of an adjustor.
Figure 10:
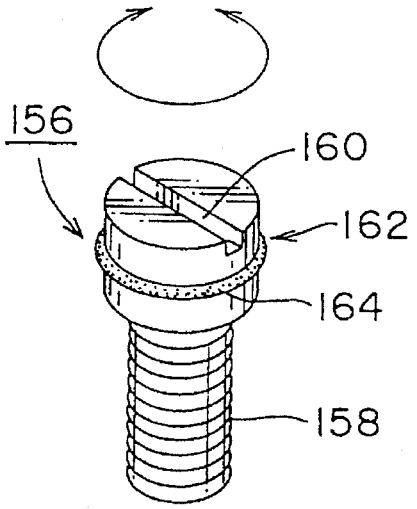
FIG. 10 is a perspective view of the adjustor of FIG. 9.

FIG. 9 is a sectional view which illustrates a structure of an adjustor 156, and FIG. 10 is a perspective view of the adjustor 156. The adjustor 156 includes a screw shaft section 158 and a head 162 having a slot in the top surface thereof, and a ring 154 is fitted to an annular groove of the periphery of the head 162. The screw shaft section 158 of the adjustor 156 is screwed to the mount base 54 and the slot 160 is engaged with a driver so that the adjustor 156 is rotated. The adjustor 156 rotates to increase or decrease its projecting amount toward a passage 114 and to increase or decrease the opening amount of the nipple 110 toward the passage 114, thereby adjusting a flow passage cross-sectional area of the passage 114, that is, a flow rate of the lubricating oil in the passage 114.

The operation of the embodiment will now be described.

The rotation power of the engine of the engine section 18 is transmitted to the gear unit 28 through the transmission shaft 36. The rotation power is changed its transmission direction at 90° by means of the bevel gears 42 and 44 in the gear unit 28, and transmitted to the rim 90 or the sprocket 100 through the output shaft 48 and the drive shaft 62. The saw chain 32 moves around the chain bar 30 to out branches and the like while being driven by the rotation of the rim 92 or the sprocket 100 and guided by means of the guide groove 132 of the chain bar 30.

On the other hand, the regenerative pump 64 integrally rotates the grooved rotor 70 with the output shaft 48 in the stirring chamber 66 by the spline-fitting of the boss 68 to the output shaft 48. The lubricating oil in the stirring chamber 66 is accelerated in a longer circumferential direction from the inlet 108 to the outlet 74 by means of the grooved rotor 70, whereby the regenerative pump 64 introduces the lubricating oil in the oil tank 78 through the inlet hose 148 and discharge the oil to the outlet 74. The lubricating oil discharged to the outlet 74 is sent to the passage 114 of the mount base 54 through the outlet hose 150, introduced from the supply port 112 of the mount base 54 to the through-holes 136 of the chain bar 30, and further, introduced to the guide groove 132 through the through-slots 138 formed in the chain bar 30 to be supplied to the saw chain 32 sliding in the guide groove 132.

By rotating the adjustor 156 in the mount base 54, the adjustor 156 is vertically displaced to increase or decrease the opening area of the nipple 110 toward the passage 114 by the shank thereof so that the amount of the lubricating oil to be introduced from the nipple 110 to the passage 114 is increased or decreased. Thus, the adjustment of the screwing amount of the adjustor 156 allows the flow rate of the lubricating oil supplied to the guide groove 132 to increase or decrease, thereby adjusting the flow rate of the lubricating oil to be supplied to the saw chain 32.

In the embodiment as described above, the saw blade machine of the present invention is applied to a trimmer 10. However, the saw blade machine of the present invention can be applied to an edger for trimming an edge of a lawn with a relative reciprocation of two saw blades 32.

In addition, in the embodiment as described above, the boss 68 of the regenerative pump 64 is penetrated through the output shaft 48 and clamped by the step portion of the drive shaft 62 screwed to the output shaft 48. However, the boss 68 may be combined with the drive shaft 62 by a spline at a section thereof fitting to the drive shaft 62.

According to the invention as claimed in claim 1, the lubricating oil pump for supplying the lubricating oil to the saw blade is fitted to the drive shaft members for driving the saw blade to be integrally rotated therewith. Thus, the input shaft of the lubricating oil pump becomes in common with the drive shaft members and separate provision of the input shaft from the drive shaft members can be omitted, thereby reducing the size of the section including the drive shaft members and the lubricating oil pump. In addition, by adopting a regenerative pump as a lubricating oil pump, the structure of the lubricating oil pump itself can be simplified and the lubricating oil pump can be mounted efficiently to the drive shaft members.

According to the invention as claimed in claim 2. the drive shaft members are provided at the forward end side of the operating rod, and the saw blade and the regenerative pump for lubricating the saw blade are mounted thereto. Thus, the saw blade machine as claimed in claim 1 can be advantageously applied to a saw blade machine of an operating rod type.

According to the invention as claimed in claim 3, the saw blade is used as a saw chain or reciprocating blade, and the saw blade machine can be used as a trimmer or an edger.

According to the invention as claimed in claim 4, the lubricating oil pump for supplying the lubricating oil to the saw blade is a regenerative pump, and a tabular rotor is fitted to the output shaft of the gear unit or to the connecting shaft coaxially connected to the output shaft. Thus, separate provision of the input shaft of the lubricating oil pump with respect to the output shaft and the connecting shaft can be omitted, and the size of the section including the output shaft, the connecting shaft and the lubricating oil pump can be reduced. Further, the structure of the lubricating oil pump itself can be simplified and the lubricating oil pump can be mounted efficiently to the output shaft and the connecting shaft.

According to the invention as claimed in claim 4, the joint case and the seal case are mounted onto the gear unit in the direction of the output shaft thereof so that the regenerative pump is disposed between the gearcase and the joint case. Thus, the section including the output shaft, the connecting shaft and the lubricating oil pump can be efficiently assembled, and manufacturing thereof can be simplified.

According to the invention as claimed in claim 5, the lubricating oil tank is formed integrally with the joint case. Thus, the section including the lubricating oil tank can be reduced in size, thereby improving manufacturing cost and manufacturing efficiency.

According to the invention as claimed in claim 6, the screw member for increasing or decreasing the flow passage cross-sectional areas of the oil passages by adjusting the screwing amount thereof is provided. This enables the flow rate of the lubricating oil supplied to the saw chain to be suitably adjusted regardless of the rotating speed of the output shaft of the gear unit.

What is claimed is:

1. A trimmer, comprising:

(a) a power section being mounted on the base side of an operating rod and generating a rotation power;

(b) a transmission shaft extending in said operating rod and transmitting the rotation power from said power section;

(c) a gear unit mounted on the forward end side of said operating rod, and transmitting the rotation power of said transmission shaft to an output shaft being in right angles to said transmission shaft;

(d) a joint case to be joined to a gearcase of said gear unit from the forward end side of said output shaft;

(e) a seal case to be joined to said joint case from the forward end side of said output shaft;

(f) a connecting shaft being coaxially connected to said output shaft and projecting toward the outside of said seal case;

(g) a regenerative pump including a stirring chamber defined between said joint case and said seal case, and a tabular rotor disposed in said stirring chamber and fitted to said output shaft or said connecting shaft to be rotated with the rotation of said output shaft;

(h) a saw chain moving along a guide groove formed in a periphery of a chain bar fixed to said joint case, the rotation from said connecting shaft being transmitted to said saw chain; and (i) oil passages including a through-slot formed in said chain bar to be communicated with said guide groove and conducting a lubricating oil from said regenerative pump to said guide groove.

2. A trimmer according to claim 1, wherein said joint case is integrally provided with a lubricating oil tank storing the lubricating oil drawn by said regenerative pump.

3. A trimmer according to claim 1 or 2, further comprising a screw member being displace in the axial direction in accordance with increase or decrease of screwing amount thereof so as to increase or decrease flow passage cross-sectional areas of said oil passages.

* * * * *